US005330172A

United States Patent [19]

Seydel

[11] Patent Number: 5,330,172

[45] Date of Patent: Jul. 19, 1994

[54] HOLDING BAR ASSEMBLY OF A PAPER SHEET-PROCESSING MACHINE AND METHOD OF GUIDING AND TRANSPORTING THE HOLDING BAR

[75] Inventor: Michael Seydel, Eppelheim, Fed. Rep. of Germany

[73] Assignee: Heidelberger Druckmaschinen AG, Heidelberg, Fed. Rep. of Germany

[21] Appl. No.: 83,977

[22] Filed: Jun. 28, 1993

[30] Foreign Application Priority Data

Jul. 1, 1992 [DE] Fed. Rep. of Germany ..... 4221580

[51] Int. Cl.[5] ..... B65H 29/04

[52] U.S. Cl. ..... 271/204; 101/142; 271/277

[58] Field of Search ..... 271/204, 205, 206, 277; 101/142

[56] References Cited

U.S. PATENT DOCUMENTS 3,826,486 7/1974 Abendroth ..... 271/204
4,369,963 1/1983 Jamieson ..... 271/204
4,550,904 11/1985 Union ..... 271/204 X

*Primary Examiner*—Richard A. Schacher
*Attorney, Agent, or Firm*—Herbert L. Lerner; Laurence A. Greenberg

[57] ABSTRACT

An assembly including a holding bar disposed transversely to a sheet-conveying direction in a paper sheet-processing machine, includes a device on the holding bar for holding paper sheets; a device for guiding the holding bar in individual, laterally spaced-apart guiding planes and through at least one direction-changing region located outside the guiding planes; a device for transporting the holding bar; and, in the at least one direction-changing region outside the guiding planes, a connectible device for stiffening the holding bar; and a method of guiding and transporting the holding bar.

9 Claims, 4 Drawing Sheets

HOLDING BAR ASSEMBLY OF A PAPER SHEET-PROCESSING MACHINE AND METHOD OF GUIDING AND TRANSPORTING THE HOLDING BAR

The invention relates to an assembly including a holding bar disposed transversely to a sheet-conveying direction in a paper sheet-processing machine as well as to a method of guiding and transporting the holding bar wherein the holding bar is moved in the sheet-conveying direction and is guided through direction-reversing regions.

Such holding bar assemblies and methods of guiding and transporting such holding bars have become known heretofore, for example, from their use in delivery regions of sheet-fed printing presses. Heretofore known, for example, are gripper bars on revolving chains for accepting sheets which have been printed in preceding printing units and for conveying the paper sheets to a delivery pile, the revolving chains being guided over respective chain sprockets in a sheet-transfer region as well as in a connecting region adjacent to the delivery pile. In direction-reversal regions of both of the chain sprockets, respectively, the gripper bars are subject to high centrifugal forces, especially at very high conveying speeds. At high speeds, the high centrifugal forces, which act upon the mass of a gripper bar, as well as upon the individual masses of grippers distributed on the gripper bar and across the width of the sheet, cause an outward transverse bending of the gripper bar between contact regions on the chain sprockets. The parts which are thus displaced from an intended guide plane thereof are subject to a risk of collision with other printing-press parts, for example, with a gripper bar of a preceding cylinder, in the direction-reversal region at which sheet acceptance from a last printing unit is effected. Such collisions may cause disruptions in the paper transport, and also the destruction of individual printing-press parts. After the gripper bar has swung into a region wherein it is guided rectilinearly, accepted or transferred paper sheets may be undesirably stressed or twisted by the grippers, and may possibly be damaged, due to backward bending of the gripper bars. Furthermore, acceptance or transfer of the sheets may be rendered more difficult due to the fact that the grippers are not in the positions in which they should be for sheet acceptance or transfer, the extent of positional error even differing from one gripper to the next. Acceptance streaks resulting from vibrations of the gripper bars in circumferential direction, as well as varying extents of ink acceptance by the sheets as they are pulled non-uniformly through the printing nip, are possible.

It has become known heretofore to counteract such transverse bending by providing a greater stiffness in the beam profile section of the gripper bars. A lasting or permanent stiffening of a beam profile section calls for an increased mass of the beam profile section, especially if it is travelling at high speeds. The mass must be accelerated, decelerated and driven by the drive system. Due to reactions, the increased mass causes undesired vibrations in other regions of the printing press also. Because of the stiffened profile, aerodynamic considerations with regard to flutter-free sheet transport must be laid aside.

It is accordingly an object of the invention to provide an improvement in a holding bar disposed transversely to a sheet-conveying direction in a paper sheet-processing machine, as well as in a method of guiding and transporting the holding bar which includes moving the holding bar in the sheet-conveying direction and guiding it through direction-reversing regions, wherein the holding bar is of relatively light weight and has a relatively simple profile, yet is also safely guided, even at high speeds.

With the foregoing and other objects in view, there is provided, in accordance with the invention, an assembly including a holding bar disposed transversely to a sheet-conveying direction in a paper sheet-processing machine, comprising means on the holding bar for holding paper sheets; means for guiding the holding bar in individual, laterally spaced-apart guiding planes and through at least one direction-changing region located outside the guiding planes; means for transporting the holding bar; and, in the at least one direction-changing region outside the guiding planes, connectible means for stiffening the holding bar.

Due to the additional means connectible in the direction-reversing region for stiffening the holding bar outside of the guiding planes for the holding bar, holding bars of relatively lesser stiffness may be conveyed reliably in regions wherein there are greater demands with respect to stiffness.

In accordance with another feature of the invention, means are provided for moving the stiffening means in synchronism with the holding bar; the stiffening means comprising force-applying means for applying force automatically to the holding bar in opposition to inertial forces exerted thereon. A relatively simple formation of the additional stiffening by means of a targeted, slip-free application of forces acting opposite to the inertial forces is thus afforded.

In accordance with a further feature of the invention, a plurality of revolving filiform carriers are disposed in the guiding planes, respectively, the holding bar being fastened to the carriers, revolving direction-reversing means are disposed in the guiding planes and in the at least one direction-changing region for guiding the carriers; and means for holding the stiffening means are disposed in a plane parallel to the guiding planes, wherein the direction-reversing means are disposed, for guiding the holding bar in the direction-changing region. This construction permits a relatively simple positioning of the stiffening holding means.

In accordance with an added feature of the invention, at least two flexible filiform transport means are disposed in the guide planes, respectively, the holding bar being fastened to the two transport means, revolving direction-reversing surfaces are disposed in the at least one direction-changing region for guiding the two transport means therearound in mutually parallel relationship, and means are provided for tightly holding the stiffening means with a force opposing centrifugal forces exerted on the holding bar, the holding means being disposed between and movable parallel to the direction-reversing surfaces of the at least one direction-changing region. This construction provides an advantageous and relatively simple assembly without requiring any additional expense for driving means.

In accordance with an additional feature of the invention, the revolving direction-reversing surfaces of the at least one direction-changing region are coaxially journalled and have a disc-shaped construction of given radius, and the holding means have a radius smaller than the given radius and are mounted coaxially with the direction-reversing surfaces, the holding means being drivable in time with sheet conveyance at an angular interval corresponding to an interval to a next conveyed holding bar for automatically gripping the holding bar. This construction represents a preferred embodiment wherein the stiffening holding means can be incorporated without major expense into already existing direction-reversing configurations.

In accordance with yet another feature of the invention, the automatically gripping holding means comprise at least one magnet.

In accordance with yet a further feature of the invention, the automatically gripping holding means are mounted so as to be fixed against rotation relative to the direction-reversing surfaces. With this feature, it is additionally possible to dispense with a separate drive.

In accordance with a concomitant feature of the invention, the means for transporting the holding bar comprise two chains to which the holding bar is fastened, the chains being guidable in parallel over respective direction-reversing sprockets coaxially journalled in side frames of the printing press in the at least one direction-changing region; the holding-bar stiffening means comprising a disc having a diameter smaller than that of the direction-reversing sprockets and being coaxially mounted therebetween, the disc being drivable with the direction-reversing sprockets in synchronism with the holding bar, and a magnet fastened to the disc at the outer circumference thereof and having an outer surface magnetically attracting an inner surface on the holding bar. This construction represents a preferred embodiment.

In accordance with another aspect of the invention, there is provided a method of guiding and transporting a holding bar aligned transversely to a sheet-conveying direction in a paper sheet-processing machine, which comprises moving the holding bar in the sheet-conveying direction and guiding it through at least one direction-reversing region and, in the at least one direction-reversing region, automatically stiffening the holding bar in opposition to transverse bending of the holding bar by inertial forces.

Other features which are considered as characteristic for the invention are set forth in the appended claims.

Although the invention is illustrated and described herein as embodied in a holding bar of a paper sheet-processing machine and a method of guiding and transporting the holding bar, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
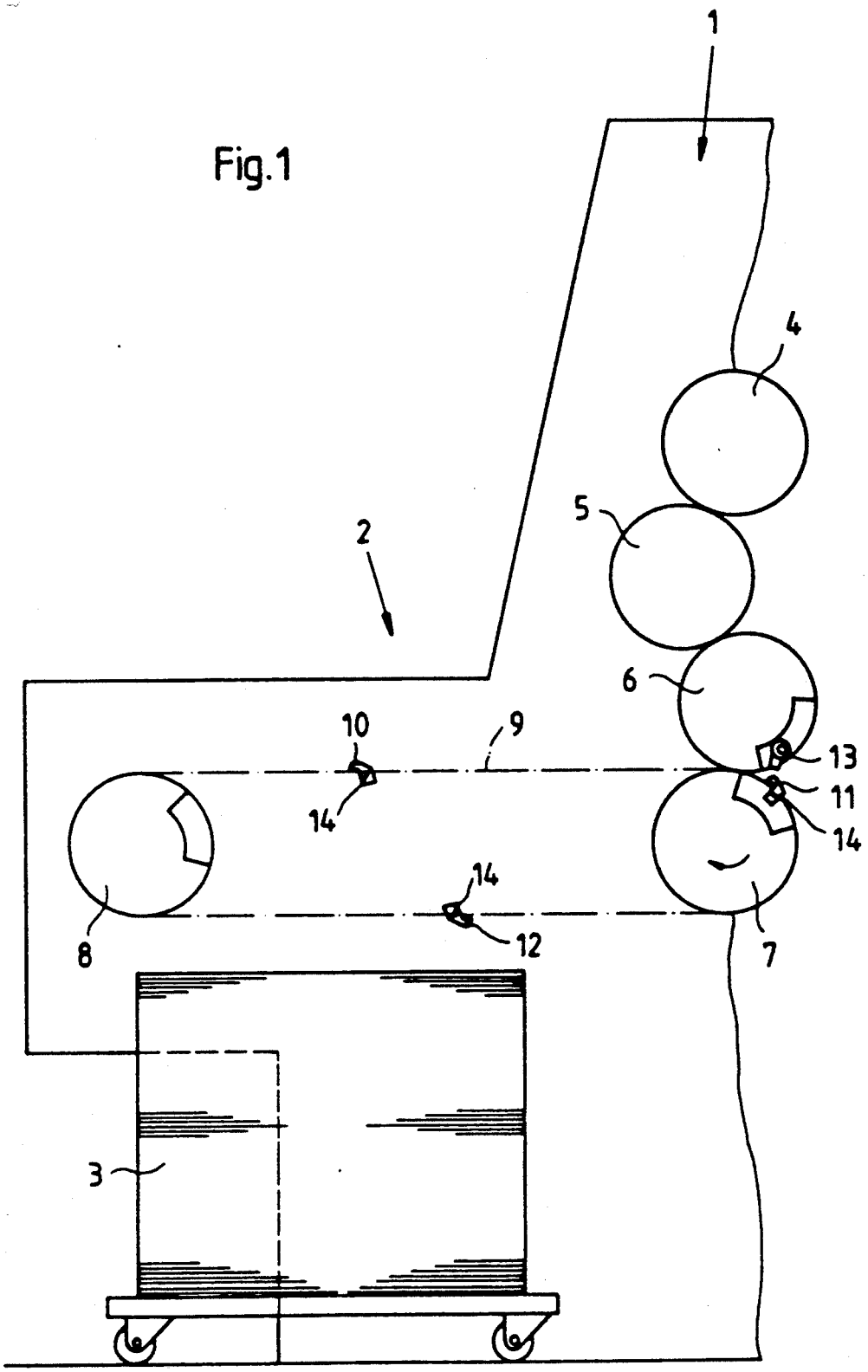
FIG. 1 is a diagrammatic side elevational view of a delivery region, including part of a last printing unit of a sheet-fed rotary offset printing press.

Referring now to the drawings and, first, particularly to FIG. 1 thereof, there is shown therein a delivery region of a sheet-fed rotary offset printing press wherein, by a plate cylinder 4 through the intermediary of a blanket cylinder 5, non-illustrated paper sheets are printed between the blanket cylinder 5 and an impression cylinder 6 of a last printing unit 1. The paper sheets are transferred in a conventional manner from grippers 13 of the impression cylinder 6 to grippers 10, 11 and 12 of uniformly spaced gripper bars 14 which are fastened to revolving chains 9. The chains 9 are revolvingly guided and driven in a conventional manner in a forward direction-reversal region 7 and a rearward direction-reversal region 8. The paper sheets are transported by the gripper bars 14 over a delivery pile 3, on which the sheets are deposited after the grippers 10, 11 and 12 have opened.

Figure 2:
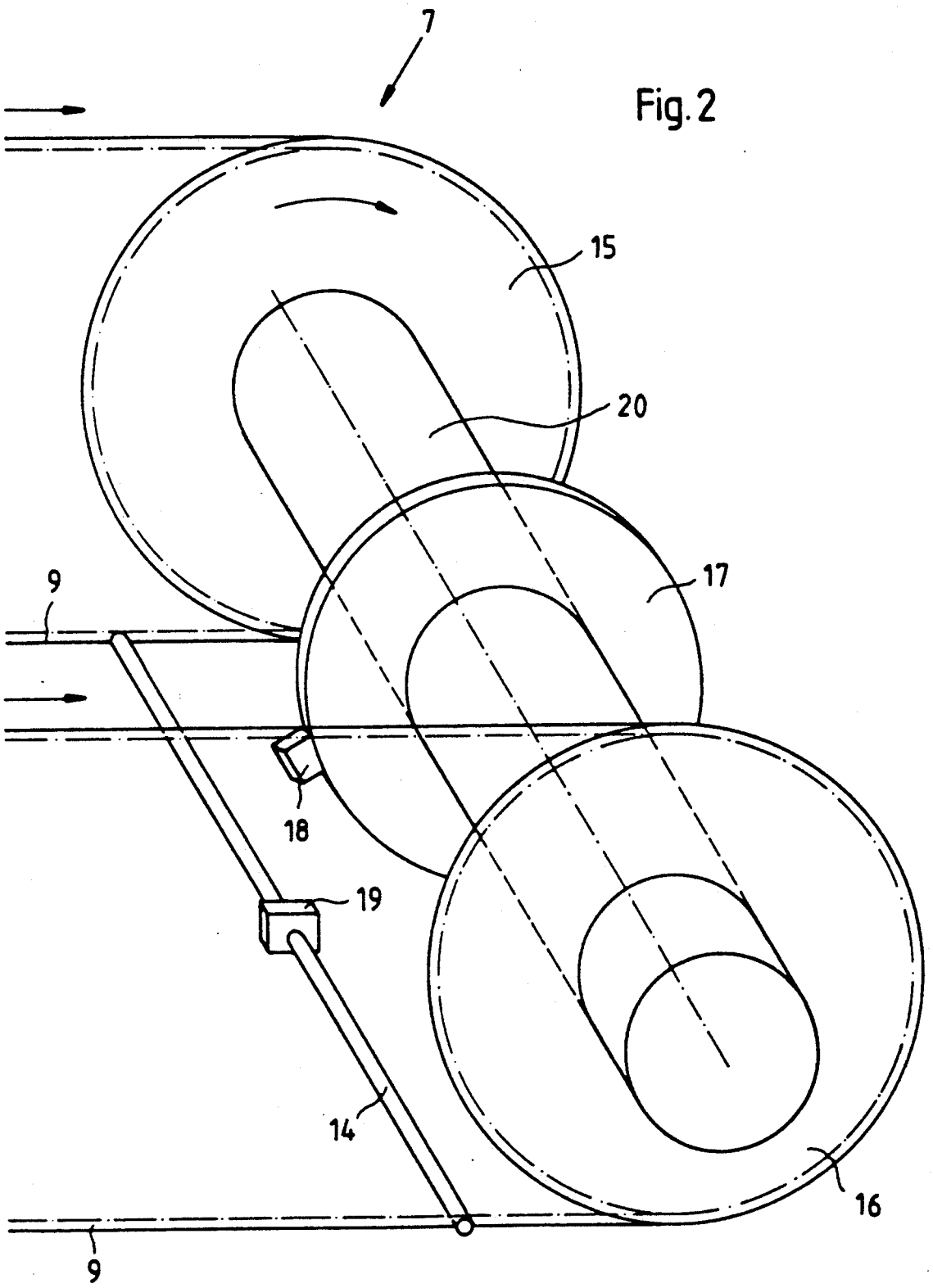
FIG. 2 is an enlarged fragmentary perspective view of FIG. 1, showing a first embodiment of the invention wherein permanent magnets are provided in a forward direction-reversal region of a chain gripper bar, located at the right-hand side of FIG. 1, after a stiffening of the chain gripper bar has been relieved or removed.

In the front direction-reversal region 7, as shown in FIG. 2, the chains 9 are guided over chain sprockets 15 and 16 which are coaxially mounted on a driven shaft 20 journalled in non-illustrated side frames of the printing press. Mounted centrally and likewise coaxially between the two chain sprockets 15 and 16 is a circular disc 17 having a smaller radius than the radius of the chain sprockets 15 and 16. A magnet 18 is fastened to the outer circumference of the disc 17. The magnet 18 is disposed at a given angular position on the disc 17 so that it cooperates with a respective holding surface 19 of the gripper rails 14, in the direction-reversal region 7 of the gripper bars 14.

Figure 3:
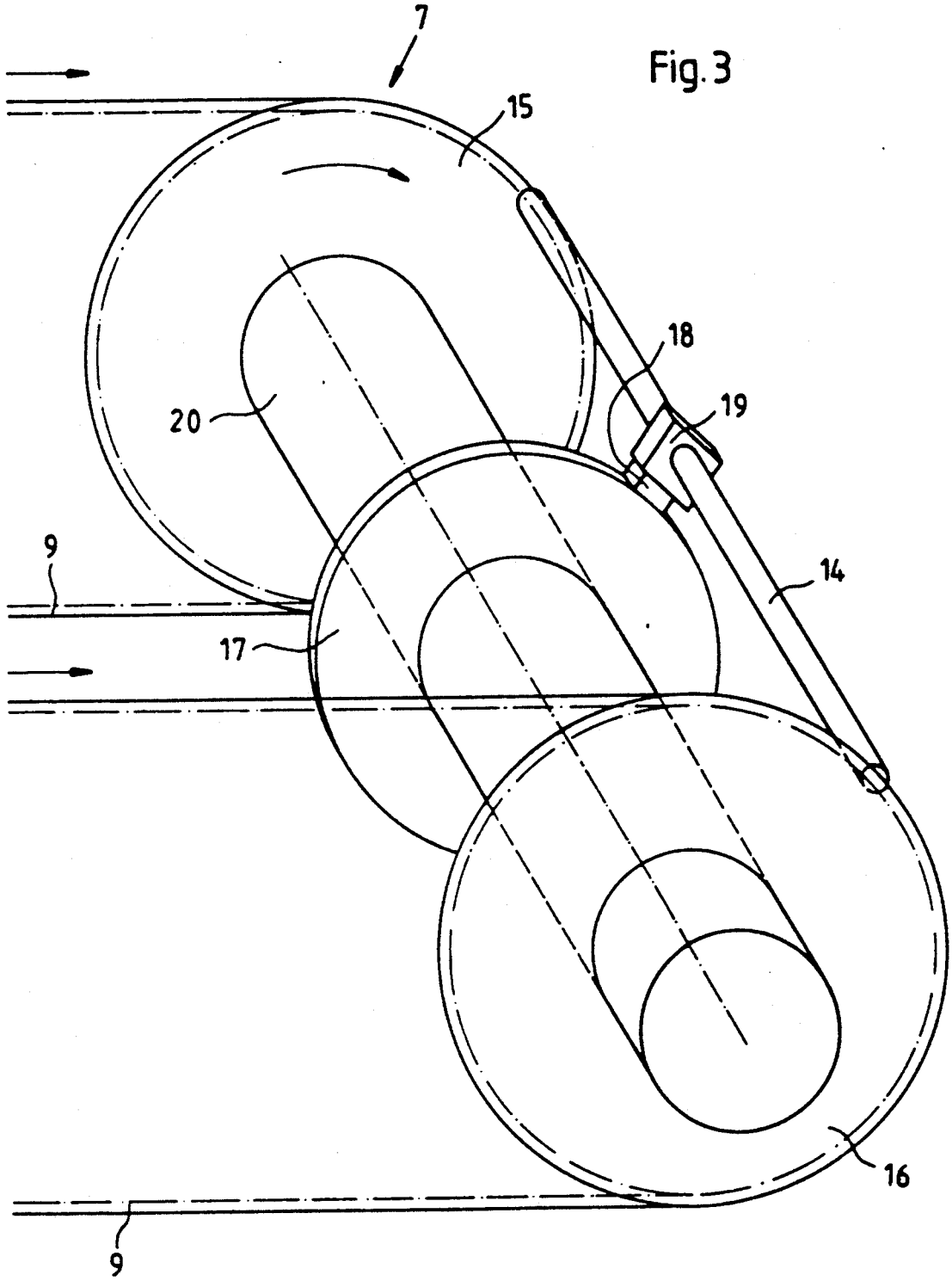
FIG. 3 is a view like that of FIG. 2 of the first embodiment of the invention in another operating phase thereof wherein the chain gripper bar is stiffened.

The individual grippers 11, 12 and 13 are not shown on the respective gripper bars 14 in FIGS. 2 and 3.

The gripper bars 14 are transported into the direction-reversal region 7 by the upper sides of the chains. The magnet 18 on the disc 17 pulls the contact surface 19 of the respective gripper bar 14 radially towards the shaft 20, i.e., in a direction opposite to centrifugal forces acting upon the gripper bar 14. The inner region of the gripper bar 14 between the chain sprockets 15 and 16 thereby travels or migrates outwardly away from the shaft 20 without being accompanied by transverse bending of the gripper bar 14.

The gripper bar 14 is reliably or safely guided between the chain sprockets 15 and 16, as shown in FIG. 3. The instant the gripper bar 14 leaves the direction-reversal region 7, the magnetic connection between the magnet 18 and the holding surface 19 is released.

It is also conceivable, additionally, to provide the gripper bar 14 with suitably polarized magnetic surfaces for attraction with the magnet 18.

Figure 4:
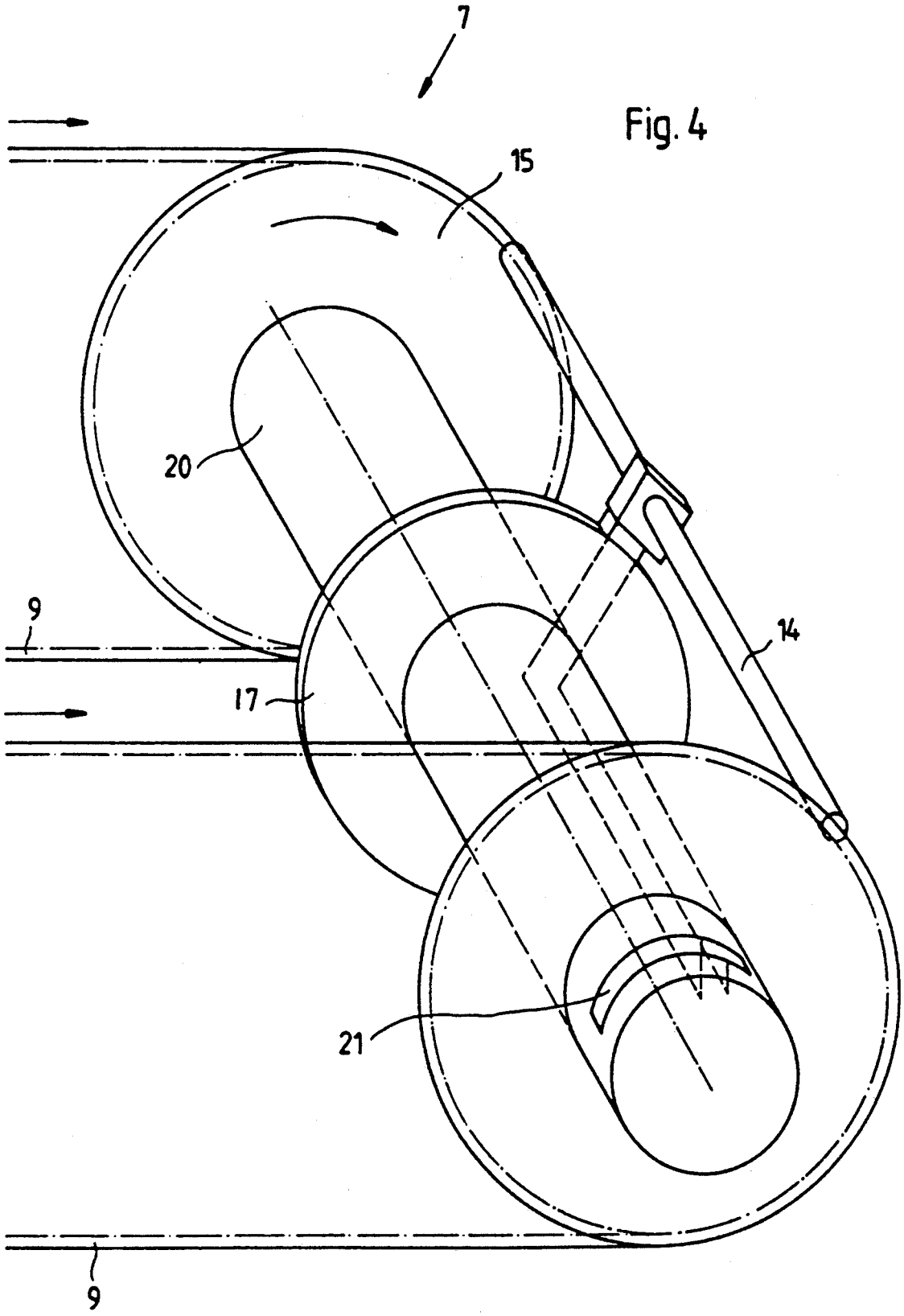
FIG. 4 is a view like that of FIG. 3 of a second embodiment of the invention wherein an electromagnet has replaced at least one of the permanent magnets.

As shown in FIG. 4, it is likewise conceivable to make selected circumferential regions of the disc 17 electromagnetic by means of slip rings 21 which are located in the vicinity of an end of the shaft 20.

The foregoing is a description corresponding in substance to German Application P 42 21 580.3, dated Jul. 1, 1992, the International priority of which is being claimed for the instant application, and which is hereby made part of this application. Any material discrepancies between the foregoing specification and the aforementioned corresponding German application are to be resolved in favor of the latter.

I claim:

1. An assembly including a holding bar disposed transversely to a sheet-conveying direction in a paper sheet-processing machine, comprising means on the holding bar for holding paper sheets; means for guiding the holding bar in individual, laterally spaced-apart guiding planes and through at least one direction-changing region located outside said guiding planes; means for transporting the holding bar; and, in said at least one direction-changing region outside said guiding planes, connectible means for stiffening the holding bar.

2. Assembly according to claim 1, including means for moving said stiffening means in synchronism with the holding bar; said stiffening means comprising force-applying means for applying force automatically to the holding bar in opposition to inertial forces exerted thereon.

3. Assembly according to claim 1, including a plurality of revolving filiform carriers disposed in said guiding planes, respectively, the holding bar being fastened to said carriers, revolving direction-reversing means disposed in said guiding planes and in said at least one direction-changing region for guiding said carriers; and means for holding said stiffening means disposed in a plane parallel to said guiding planes, wherein said direction-reversing means are disposed, for guiding the holding bar in said direction-changing region.

4. Assembly according to claim 1, including at least two flexible filiform transport means disposed in said guide planes, respectively, the holding bar being fastened to said two transport means, revolving direction-reversing surfaces disposed in said at least one direction-changing region for guiding said two transport means therearound in mutually parallel relationship, means for tightly holding said stiffening means with a force opposing centrifugal forces exerted on the holding bar, said holding means being disposed between and movable parallel to said direction-reversing surfaces of said at least one direction-changing region.

5. Assembly according to claim 4, wherein said revolving direction-reversing surfaces of said at least one direction-changing region are coaxially journalled and have a disc-shaped construction of given radius, and said holding means have a radius smaller than said given radius and are mounted coaxially with said direction-reversing surfaces, said holding means being drivable in time with sheet conveyance at an angular interval corresponding to an interval to a next conveyed holding bar for automatically gripping the holding bar.

6. Assembly according to claim 5, wherein said automatically gripping holding means comprise at least one magnet.

7. Assembly according to claim 1, wherein said means for transporting the holding bar comprise two chains to which the holding bar is fastened, said chains being guidable in parallel over respective direction-reversing sprockets coaxially journalled in side frames of the printing press in said at least one direction-changing region; said holding-bar stiffening means comprising a disc having a diameter smaller than that of said direction-reversing sprockets and being coaxially mounted therebetween, said disc being drivable with said direction-reversing sprockets in synchronism with the holding bar, and a magnet fastened to said disc at the outer circumference thereof and having an outer surface magnetically attracting an inner surface on the holding bar.

8. Assembly according to claim 5, wherein said automatically gripping holding means are mounted so as to be fixed against rotation relative to said direction-reversing surfaces.

9. Method of guiding and transporting a holding bar aligned transversely to a sheet-conveying direction in a paper sheet-processing machine, which comprises moving the holding bar in the sheet-conveying direction and guiding it through at least one direction-reversing region and, in the at least one direction-reversing region, automatically stiffening the holding bar in opposition to transverse bending of the holding bar by inertial forces.

* * * * *